US008956030B1

(12) United States Patent
Wesson

(10) Patent No.: US 8,956,030 B1
(45) Date of Patent: Feb. 17, 2015

(54) AUTOMOTIVE BULBS HAVING LEDS POINTING IN DIFFERENT DIRECTIONS

(71) Applicant: Bruce Wesson, Newton, MS (US)

(72) Inventor: Bruce Wesson, Newton, MS (US)

(73) Assignee: Jam Strait, Inc., Newton, MS (US)

( * ) Notice: Subject to any disclaimer, the term of this patent is extended or adjusted under 35 U.S.C. 154(b) by 0 days.

(21) Appl. No.: 13/858,628

(22) Filed: Apr. 8, 2013

Related U.S. Application Data

(63) Continuation of application No. 12/698,021, filed on Feb. 1, 2010, now abandoned, which is a continuation-in-part of application No. 11/532,882, filed on Sep. 18, 2006, now abandoned.

(60) Provisional application No. 60/717,639, filed on Sep. 16, 2005.

(51) Int. Cl.

| | |
|---|---|
| ***H01R 33/05*** | (2006.01) |
| ***H01R 33/09*** | (2006.01) |
| ***H01R 33/46*** | (2006.01) |
| ***F21S 8/10*** | (2006.01) |

(52) U.S. Cl.
CPC ..... *F21S 48/00* (2013.01)
USPC ..... 362/545; 362/646; 362/647; 362/652; 362/657; 362/658

(58) Field of Classification Search
USPC ..... 362/545, 646–659, 252
See application file for complete search history.

(56) References Cited

U.S. PATENT DOCUMENTS

| | | | | | |
|---|---|---|---|---|---|
| 3,349,280 | A | * | 10/1967 | Siiberg | 315/77 |
| 4,618,205 | A | * | 10/1986 | Freeman | 439/573 |
| 4,628,415 | A | * | 12/1986 | Vescio et al. | 362/548 |
| 4,727,289 | A | * | 2/1988 | Uchida | 315/71 |
| 5,160,200 | A | * | 11/1992 | Cheselske | 362/249.06 |
| 5,160,201 | A | * | 11/1992 | Wrobel | 362/249.03 |
| 5,688,042 | A | * | 11/1997 | Madadi et al. | 362/240 |
| 5,806,965 | A | * | 9/1998 | Deese | 362/249.04 |
| 5,947,588 | A | * | 9/1999 | Huang | 362/235 |
| 6,357,902 | B1 | * | 3/2002 | Horowitz | 362/545 |
| 6,465,961 | B1 | * | 10/2002 | Cao | 315/58 |
| 6,525,668 | B1 | * | 2/2003 | Petrick | 340/815.45 |
| 6,598,996 | B1 | * | 7/2003 | Lodhie | 362/249.05 |
| 6,621,222 | B1 | * | 9/2003 | Hong | 315/51 |
| 6,786,625 | B2 | * | 9/2004 | Wesson | 362/545 |
| 6,886,963 | B2 | * | 5/2005 | Lodhie | 362/235 |
| 7,261,437 | B2 | * | 8/2007 | Coushaine et al. | 362/255 |
| 7,726,836 | B2 | * | 6/2010 | Chen | 362/249.02 |
| 7,806,561 | B2 | * | 10/2010 | Chen | 362/265 |
| 7,923,907 | B2 | * | 4/2011 | Tessnow et al. | 313/46 |
| 8,128,258 | B2 | * | 3/2012 | Lodhie | 362/249.02 |

* cited by examiner

*Primary Examiner* — Ismael Negron
(74) *Attorney, Agent, or Firm* — Garvey, Smith, Nehrbass & North, L.L.C.; Seth M. Nehrbass; Mackenzie Dismore Rodriguez

(57) ABSTRACT

Automotive bulbs and including at least one printed circuit board electrically connected to a standard automotive bulb base, and a plurality of light emitting diodes (LEDs) arranged on the circuit board to project light in at least two opposite directions. In some embodiments, circuit boards are arranged in an X pattern, and the LEDs are arranged to project light in substantially all directions about the longitudinal axis of the automotive bulb.

12 Claims, 4 Drawing Sheets

AUTOMOTIVE BULBS HAVING LEDS POINTING IN DIFFERENT DIRECTIONS

CROSS-REFERENCE TO RELATED APPLICATIONS

This is a continuation of U.S. patent application Ser. No. 12/698,021, filed 1 Feb. 2010, which is a continuation-in-part of my co-pending U.S. patent application Ser. No. 11/532,882, filed 18 Sep. 2006, both of which are incorporated herein by reference.

U.S. patent application Ser. No. 11/532,882, filed 18 Sep. 2006, claims priority of my U.S. Provisional Patent Application No. 60/717,639, filed 16 Sep. 2005, for "MULTI ANGLE FUNCTIONING LED BULBS AND LAMPS," which is incorporated herein by reference. Priority of U.S. Provisional Patent Application No. 60/717,639, filed 16 Sep. 2005, is hereby claimed.

My. U.S. patent application Ser. No. 11/057,691, filed 14 Feb. 2005, issued as U.S. Pat. No. 7,566,142 on 28 Jul. 2009, for "Changing color LEDs" is incorporated herein by reference; however, this is not a continuation-in-part of that patent application.

My U.S. Provisional Patent Application No. 60/544,409, filed 13 Feb. 2004 for "Changing Color LEDs" is incorporated herein by reference.

My U.S. patent application Ser. No. 10/730,744, filed 8 Dec. 2003 for "Loaded LED Bulbs for Incandescent/Fluorescent/Neon/Xenon/Halogen Bulbs Replacement in Load Sensitive Applications and more" is incorporated herein by reference; however, this is not a continuation-in-part of that patent application.

My U.S. patent application Ser. No. 10/408,768, filed 7 Apr. 2003 for "LED Products: Flashing LED Display and Decorative LEDs for Autos and Trucks" is incorporated herein by reference; however, this is not a continuation-in-part of that patent application.

My U.S. Provisional Patent Application Ser. No. 60/431,333, filed 6 Dec. 2002, is incorporated herein by reference.

U.S. patent application Ser. No. 10/123,542, filed 16 Apr. 2002, issued as U.S. Pat. No. 6,786,625 on 7 Sep. 2004, is incorporated herein by reference; however, this is not a continuation-in-part of that patent application.

My U.S. Provisional Patent Application Ser. No. 60/370,319, filed 5 Apr. 2002, is incorporated herein by reference.

My U.S. Provisional Patent Application Ser. No. 60/346,666, filed 8 Jan. 2002, is incorporated herein by reference.

My U.S. Provisional Patent Application Ser. No. 60/345,788, filed 31 Dec. 2001, is incorporated herein by reference.

U.S. patent application Ser. No. 09/578,813, filed 24 May 2000, issued as U.S. Pat. No. 6,371,636 on 16 Apr. 2002, is incorporated herein by reference; however, this is not a continuation-in-part of that patent application.

My U.S. Provisional Patent Application Ser. No. 60/135,797, filed 24 May 1999, is incorporated herein by reference.

Incorporated herein by reference are all of my US patent applications and patents, and all published versions thereof, including:

PUB. APP. NO. Title
20110018436 Loaded LED Bulbs for Incandescent/Fluorescent/Neon/Xenon/Halogen Bulbs Replacement in Load Sensitive Applications and more
20080037262 Loaded LED bulbs for incandescent/fluorescent/neon/xenon/halogen bulbs replacement in load sensitive applications and more
20050195597 Changing color LEDS 20040085781 LED products: flashing LED display and decorative LEDs for autos and trucks
20020191416 LED light module for vehicles
PAT. NO. Title
U.S. Pat. No. 7,871,178 LED Products: Flashing LED Display and Decoratice LEDs for Autos and Trucks
U.S. Pat. No. 7,566,142 Changing color LEDS
U.S. Pat. No. 6,786,625 LED light module for vehicles
U.S. Pat. No. 6,371,636 LED light module for vehicles.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates generally to light-emitting diodes (LEDs) and more particularly to versatile LEDs for use in a variety of applications.

2. Background

Incorporated herein by reference are the following:

PUB. APP. NO. Title
20110018436 Loaded LED Bulbs for Incandescent/Fluorescent/Neon/Xenon/Halogen Bulbs Replacement in Load Sensitive Applications and more
20080037262 Loaded LED bulbs for incandescent/fluorescent/neon/xenon/halogen bulbs replacement in load sensitive applications and more
20050195597 Changing color LEDS
20040085781 LED products: flashing LED display and decorative LEDs for autos and trucks
20020191416 LED light module for vehicles
PAT. NO. Title
U.S. Pat. No. 7,871,178 LED Products: Flashing LED Display and Decoratice LEDs for Autos and Trucks
U.S. Pat. No. 7,566,142 Changing color LEDS
U.S. Pat. No. 6,786,625 LED light module for vehicles
U.S. Pat. No. 6,371,636 LED light module for vehicles.
U.S. Pat. Nos. 7,040,790; 6,563,269; 6,585,385; 5,378,931; 5,748,459; 4,115,790 and 6,784,357.

U.S. Published Patent Application Nos: 2005/0213326; 2006/0082322; 2006/0192502; and 2006/0055012.

U.S. Pat. Nos. 6,634,771; 6,621,222; 6,598,996; 6,709,132; 6,902,308; 7,059,754; 7,011,430; 7,086,756; 6,523,978; 5,806,965; and 5,561,346.

U.S. Published Patent Application Nos: 2004/0114367; 2005/0174769; 2002/1091396; and 2002/0176253.

See also www.SpiderLite.com and Publication No. US 2005/0099810 A1.

SUMMARY OF THE INVENTION

The present invention includes versatile LEDs for use in a variety of applications. The present invention includes Multi Angle Functioning Led Bulbs and Lamps.

"Single bright" as used herein means LED lamps which typically shine at a single brightness when on, while "double bright" refers to LED lamps (such as those described in my prior patents) which shine at two different brightnesses when on (such as an LED lamp functioning as a tail light and a brake light).

PCB refers to printed circuit board. LED or Led refers to light-emitting diode.

The bulbs of the present invention can be used in the applications mentioned in my prior patents and patent applications.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements.

DESCRIPTION OF THE PREFERRED EMBODIMENTS

Figure 1:
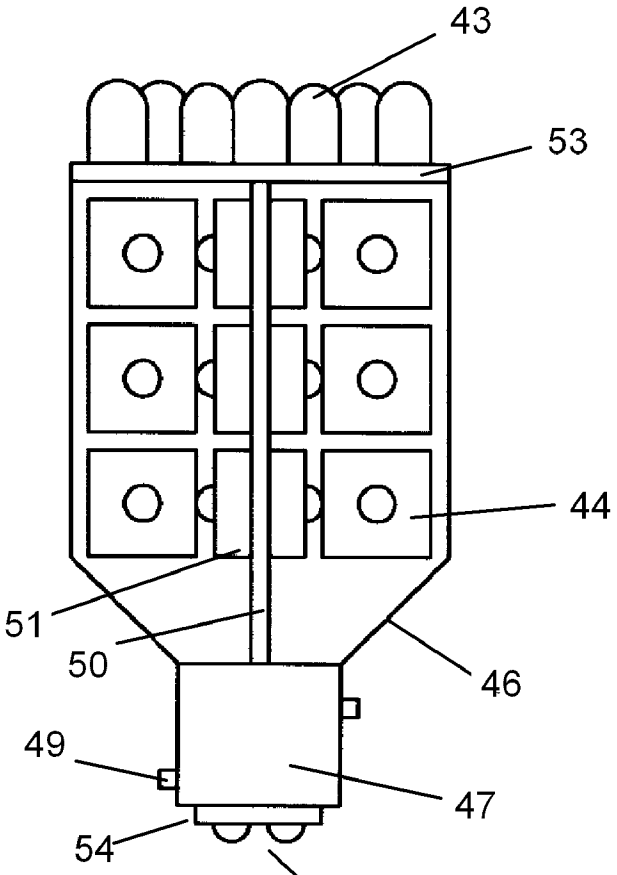
FIG. 1 shows a preferred embodiment of the present invention, and is a Single and Dual Bright Multi-Directional Automotive LED Bulb/Lamp side view assembled X pattern bayonet bulb.

Although specific embodiments of the present invention will now be described with reference to the drawings, it should be understood that such embodiments are by way of example only, and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

1 Multi-Directional LED Bulbs and Lamps

LED bulbs and lamps with LEDs pointing to the sides, top, bottom, and even to the back in addition to the front are desirable to light up more or different parts of the lamp and or lens or to produce more total light in many applications. Various viewing angles and configurations are used to achieve the desired light pattern and brightness. If the correct viewing angle and number of LEDs are selected and placed at the proper locations, it is possible to emit light at the same or near same viewing angle of the incandescent bulb for that application. Restrictions and customizations are achieved by changing the variables of PCBs, LEDs and positioning during the manufacturing process. One group of examples are lollipop LED bulbs with one or more PCBs where LEDs face opposite directions in various or same colors that replace incandescent bulbs in fender top mounted turn signal and running lights on freight trucks. Typically they have amber lenses on front and red on rear facing, but it is also common for red and red. The LED colors, types, brightness, viewing angles and so forth as well as positioning are preferably all determined for specific applications. A second group of examples are single or multi directional LED bulbs for cab top lights in trucks. Another example is one or more PCB radial LED bulbs used for tail lights, running lights, marker lights, and much more where light is directed both directly to lens and also directed to reflector or housing. The embodiments are virtually limitless but examples are shown using 1 PCB, 2 PCBs, 3 PCBs, 4 PCBs and 5 PCB in a variety of arrangements, using various circuitries, positioning and configurations each for use in specific or universal applications. Applications are encompassing. Examples of some applications are flashlights, trucks, trailers, motor cycles, automobiles, marine, aviation, commercial, industrial, agricultural, government, rail, and home. These bulbs are different from prior art known to the inventor (LEDtronics bulbs) because prior art bulbs are limited to 2 stacked PCBs with LEDs on one side of one PCB pointing one way, and LEDs on one side of a second PCB, pointing out radially from the center, toward the sides. Six LEDs are each spaced 60 degrees apart in a circle, lying on their sides. The two PCBs are attached using "stanchions", preferably three, to attach the two PCB's together. In contrast, the bulbs of the present invention use no stanchions to attach only 2 PCBs together nor do the LEDs necessarily mount upright on the top of a top PCB and down flat on a second PCB in a radial configuration nor are they limited to two PCBs. All bulbs of the present invention either operate in single brightness mode, dual brightness mode, or combination, or with split LEDs (as in the prior art to U.S. Pat. No. 6,371,636) or shared single brightness LEDs (for example, brake/tail LED bulbs in which some LEDs light up for tail and all light up for brake) or integrated dual element operation (as in U.S. Pat. No. 6,371,636) if dual action.

FIG. 1 shows an automotive LED bulb comprising a base 47, printed circuit boards 50 and 53 in an X pattern, electrically connected to the base 47; the printed circuit boards 50 and 53 having two sides, and LEDs 44, 51 operatively connected to the printed circuit boards 50 and 53 and on both sides of the printed circuit boards 50, 53. The sides of the printed circuit board have main surfaces and one or more LEDs 51, 44, and 43 pointing away from one of the main surfaces and in multiple directions. Base 47 fits in a standard automobile bulb socket. Further, LED bulb has a longitudinal axis, and the PCBs 50, 53 have faces parallel to the longitudinal axis. The PCBs 50, 53 have a first edge between the two sides, with LEDs on the first edge pointing in a direction parallel to the main surfaces.

Figure 2:
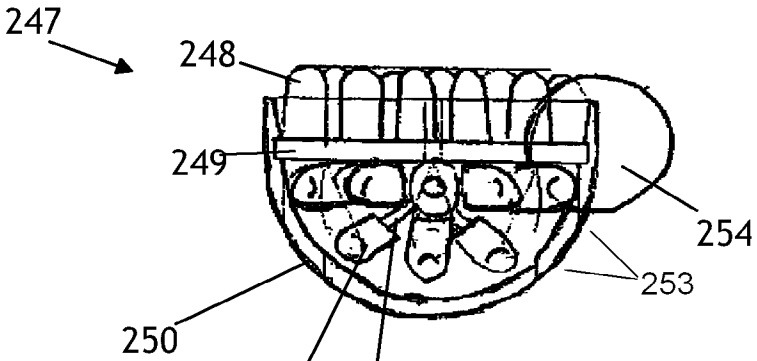
FIG. 2 shows an alternate embodiment of the present invention, and is a Single and Dual bright automotive LED bulb pcb seat.

FIG. 2 shows an automotive LED bulb 247 comprising a base which fits in a standard automobile socket, a printed circuit board 249 electrically connected to the base, the printed circuit board having two sides, LEDs 248, 251 operatively connected to the printed circuit board on both sides of the printed circuit board and wherein the sides of the printed circuit board have main surfaces and one or more LEDs 251 on one side of the printed circuit board are parallel to the main surfaces.

Figure 3:
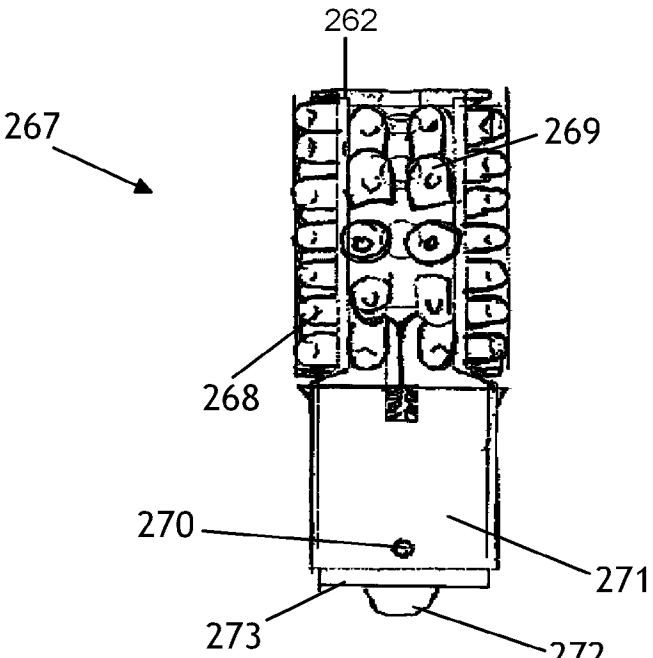
FIG. 3 shows an alternate embodiment of the present invention, and is a Single bright Multi Directional automotive LED bulb bayonet base.

FIG. 3 shows an automotive LED bulb 267 comprising a base 271 which fits in a standard automobile socket, a printed circuit board 262 electrically connected to the base, the printed circuit board having two sides, LEDs 268, 269 operatively connected to the printed circuit board on both sides of the printed circuit board, wherein the sides of the printed circuit board have main surfaces and one or more front LEDs 269 on one side of the printed circuit board are parallel to the main surfaces, the PCBs have faces parallel to the longitudinal axis, and wherein the printed circuit board has a first end proximal the base and a distal end, and one or more LEDs 269 points toward the distal end and one or more LEDs 269 points toward the proximal end.

FIG. 3 shows an automotive LED bulb 267 comprising a base 271 which fits in a standard automobile bulb socket, at least two printed circuit boards electrically connected to the base, LEDs 268, 269 operatively connected to the printed circuit boards, the bulb has a first end proximal the base and a second end distal from the base, one or more LEDs pointing to front point toward the second end, one or more LEDs 269 pointing to rear point toward the first end. Further, the bulb has a side between the first and second ends, and one or more LEDs 269 pointing to the side, LEDs 269, 268 pointing in opposite directions and all around to sides and back, and LEDs 269 on one side of each PCB pointing in opposite directions.

Figure 4:
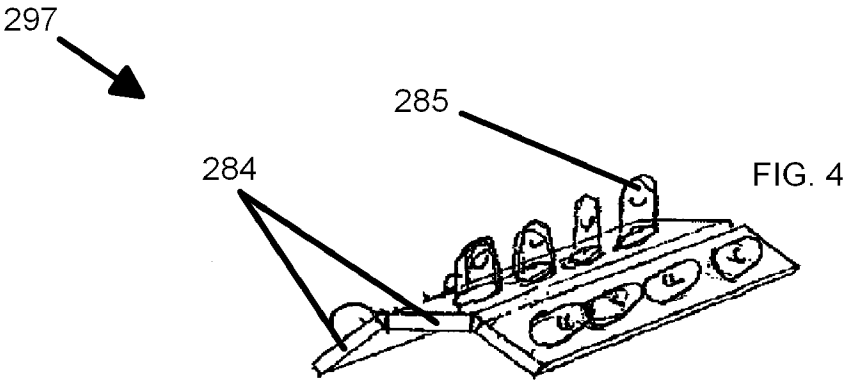
FIG. 4 shows a partial perspective view of PCBs of the present invention, with LED bulbs pointing in different directions; and, FIG. 5 shows an alternate embodiment of the present invention, and is an automotive LED replacement for tubular bulbs.

FIG. 4 is a partial perspective view of PCBs 284 with LED bulbs 285 pointing in different directions.

Figure 5:
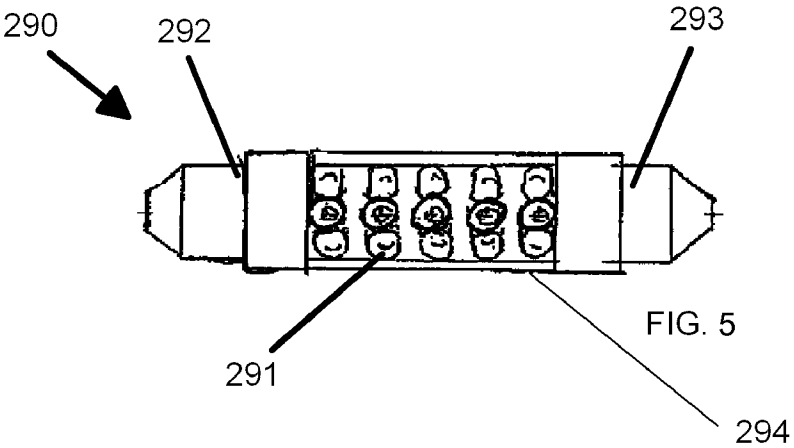

FIG. 5 shows an automotive LED replacement automotive light bulb 290 for tubular bulbs, the replacement bulb having metal contacts 292, 293 on both ends and LEDs 291 pointing in different directions.

The automotive LED replacement automotive light bulbs of the present invention preferably include a base which fits in a standard automobile bulb socket for one of the following standard automobile bulbs: 1156, 1157, 3156, 3157, 7440, 7443, 1895, 194, 5MM wedge base bulb.

Commercial embodiments of the present invention are sold by Jam Strait under model nos. 1156-HRR; 1156-HAR; 1156-HWR; 1156-HRWR; 1157-HRR; 1157-HAR; 1157-HWR; 1157-HRWR; 3157-HRR; 3157-HAR; 3157-HWR; 3157-HRWR; 7440-HRR; 7440-HAR; 7440-HWR; 7440-HRWR; 7443-HRR; 7443-HAR; 7443-HWR; 7443-HRWR; 1895-HRR; 1895-HAR; 1895-HWR; 1895-HRWR; 194-HRR; 194-HAR; 194-HWR; 194-HRWR; LDL-HRR; LDL-HAR; LDL-HWR; LDL-HRWR; 5MM-HRR; 5MM-HAR; 5MM-HWR; 5MM-HRWR; KC1; and KC2.

More information about LEDs and LED products can be found at www.jamstrait.com.

| Part No. | Description | FIG. in which it first appears |
|---|---|---|
| 43 | LED bulb | 1 |
| 44 | Square LED bulb | 1 |
| 46 | Housing | 1 |
| 47 | Bayonet base | 1 |
| 48 | Contacts | 1 |
| 49 | Index pin | 1 |
| 50 | PCB | 1 |
| 51 | Square LED bulb | 1 |
| 53 | PCB | 1 |
| 54 | Insulator | 1 |
| 247 | Single and Dual bright LED bulb PCB seat | 2 |
| 248 | LED bulb | 2 |
| 249 | PCB | 2 |
| 250 | PCB | 2 |
| 251 | LED bulb | 2 |
| 252 | Connector | 2 |
| 253 | Optional rear LEDs | 2 |
| 254 | Closeup of FIG. 35 | 2 |
| 262 | Circuit board | 3 |
| 267 | Single bright Multi Directional LED bulb bayonet base | 3 |
| 268 | LED bulb | 3 |
| 269 | LED bulb | 3 |
| 270 | index pin | 3 |
| 271 | Bayonet base | 3 |
| 272 | Contact | 3 |
| 273 | Bottom end | 3 |
| 290 | Multi Angle single pcb dome light LED bulb | 5 |
| 291 | LED bulb | 5 |
| 292 | contact | 5 |
| 293 | contact | 5 |
| 294 | Optional clear or colored tube/cover | 5 |
| 297 | Multi Angle Multi PCB dome light PCBs | 4 |

All measurements disclosed herein are at standard temperature and pressure, at sea level on Earth, unless indicated otherwise.

The foregoing embodiments are presented by way of example only; the scope of the present invention is to be limited only by the following claims.

The invention claimed is:

1. An automotive LED bulb comprising:

a base which fits in a standard automobile bulb socket for one of the following standard automobile bulbs: 1156, 1157, 3156, 3157, 7440, 7443, 1895, 194, 5MM wedge base bulb;

a printed circuit board electrically connected to the base, the printed circuit board having two sides; and LEDs operatively connected to the printed circuit board on both sides of the printed circuit board, wherein the printed circuit board has a first end proximal the base and a distal end, and at least one LED points toward the proximal end.

2. The LED bulb of claim 1, wherein the sides of the printed circuit board have main surfaces and one or more LEDs on one side of the printed circuit board are parallel to the main surfaces.

3. The LED bulb of claim 1, wherein the sides of the printed circuit board have main surfaces and one or more LEDs point away from one of the main surfaces.

4. The LED bulb of claim 1, wherein the sides of the printed circuit board have main surfaces and one or more front LEDs on one side of the printed circuit board are parallel to the main surfaces.

5. The LED bulb of claim 1, wherein the printed circuit board has a first end proximal the base and a distal end, and one or more LEDs points toward the distal end.

6. The LED bulb of claim 1, wherein the sides of the printed circuit board have main surfaces, and wherein the printed circuit board has a first edge between the two sides, with LEDs on the first edge pointing in a direction parallel to the main surfaces.

7. The LED bulb of claim 1, having a longitudinal axis and the printed circuit board having faces parallel to the longitudinal axis.

8. An automotive LED bulb comprising:

a base which fits in a standard automobile bulb socket for one of the following standard automobile bulbs: 1156, 1157, 3156, 3157, 7440, 7443, 1895, 194, 5MM wedge base bulb;

at least three printed circuit boards electrically connected to the base; and

LEDs operatively connected to the printed circuit boards, wherein the bulb has a first end proximal the base and a second end distal from the base, and one or more LEDs pointing to rear point toward the first end.

9. The LED bulb of claim 8, wherein the bulb has one or more LEDs pointing to front point toward the second end.

10. The LED bulb of claim 8, wherein the bulb has a side between the first and second ends, and one or more LEDs pointing to the side.

11. The LED bulb of claim 8, with LEDs pointing in multiple directions.

12. An automotive LED bulb comprising:

a base which fits in a standard automobile bulb socket for one of the following standard automobile bulbs: 1156, 1157, 3156, 3157, 7440, 7443, 1895, 194, 5MM wedge base bulb;

an X pattern of printed circuit boards electrically connected to the base; and

LEDs operatively connected to the printed circuit boards.

* * * * *